US009403101B2

(12) United States Patent
Thomas et al.

(10) Patent No.: US 9,403,101 B2
(45) Date of Patent: Aug. 2, 2016

(54) MULTIPLE ACTIVITY TOY

(71) Applicants: Sean L. Thomas, Minneapolis, MN (US); Pamela R. Thomas, Minneapolis, MN (US)

(72) Inventors: Sean L. Thomas, Minneapolis, MN (US); Pamela R. Thomas, Minneapolis, MN (US)

( * ) Notice: Subject to any disclaimer, the term of this patent is extended or adjusted under 35 U.S.C. 154(b) by 0 days.

(21) Appl. No.: 14/590,310

(22) Filed: Jan. 6, 2015

(65) Prior Publication Data

US 2015/0196853 A1 Jul. 16, 2015

Related U.S. Application Data

(60) Provisional application No. 61/925,742, filed on Jan. 10, 2014.

(51) Int. Cl.

| | |
|---|---|
| ***A63H 5/00*** | (2006.01) |
| ***A63H 33/26*** | (2006.01) |
| ***A63H 33/22*** | (2006.01) |

(52) U.S. Cl.

CPC ..... *A63H 33/26* (2013.01); *A63H 5/00* (2013.01); *A63H 33/22* (2013.01)

(58) Field of Classification Search

CPC ..... A63H 5/00; A63H 33/00; A63H 33/22; A63H 33/26; A63H 33/006

See application file for complete search history.

(56) References Cited

U.S. PATENT DOCUMENTS

| | | | | | |
|---|---|---|---|---|---|
| 3,466,760 | A * | 9/1969 | Vanek | G09B 23/183 | 434/224 |
| 3,654,710 | A * | 4/1972 | Barnard | G09B 19/00 | 116/263 |
| 4,321,768 | A * | 3/1982 | Engehardt | A63H 33/00 | 40/550 |
| 4,508,511 | A * | 4/1985 | McQueen | A63F 9/24 | 434/258 |
| 4,731,024 | A * | 3/1988 | Kavanagh | G09B 19/24 | 434/260 |
| 5,184,971 | A | 2/1993 | Williams | | |
| 5,207,011 | A * | 5/1993 | Coulthard | G09F 7/12 | 40/568 |
| 5,248,843 | A * | 9/1993 | Billings | A63H 5/00 | 84/609 |
| 6,116,983 | A * | 9/2000 | Long | A63H 5/00 | 446/227 |

(Continued)

FOREIGN PATENT DOCUMENTS

| | | | | |
|---|---|---|---|---|
| CN | 201997103 | 10/2011 | | |
| CN | 202263391 | 6/2012 | | |
| GB | 2264880 A * | 9/1993 | | A63F 9/24 |

*Primary Examiner* — Gene Kim
*Assistant Examiner* — Alyssa Hylinski
(74) *Attorney, Agent, or Firm* — Nikolai & Mersereau, P.A.; Thomas J. Nikolai

(57) ABSTRACT

A multiple activity toy for both entertaining and improving a child's manual dexterity includes a box-like housing having a front panel displaying a plurality of transparent or translucent graphic images and including a pair of spaced-apart three-way switches that control the on/off state of a string of battery powered LED's that are plugged into apertures located beneath the graphic images. Also included in the housing is a record/playback circuit to which a plurality of push-button switches are connected to control the recording and playback of voice, music or other sounds via a speaker mounted within the housing.

2 Claims, 3 Drawing Sheets

(56) References Cited

U.S. PATENT DOCUMENTS

| | | | | |
|---|---|---|---|---|
| 6,149,489 | A * | 11/2000 | Johnson | A63H 33/006 297/183.1 |
| 6,238,263 | B1 * | 5/2001 | Bennett | A63H 3/006 446/297 |
| 8,542,087 | B1 | 9/2013 | Spector | |
| 2002/0106624 | A1 * | 8/2002 | Chan | A63H 3/50 434/393 |
| 2003/0143920 | A1 * | 7/2003 | Greenberg | A63H 33/00 446/408 |
| 2005/0036640 | A1 * | 2/2005 | Goldenberg | A63H 5/00 381/334 |
| 2007/0243791 | A1 * | 10/2007 | Stedman | A63H 5/00 446/227 |
| 2010/0099330 | A1 * | 4/2010 | Digiovanni | A63H 5/00 446/404 |
| 2011/0011240 | A1 | 1/2011 | Sorribes Arambul | |
| 2011/0025912 | A1 | 2/2011 | Regler | |
| 2012/0322343 | A1 * | 12/2012 | Fogarty | A63H 33/26 446/485 |
| 2013/0040532 | A1 | 2/2013 | Khubani | |
| 2014/0024284 | A1 * | 1/2014 | Keenan | A47D 15/003 446/227 |

* cited by examiner

MULTIPLE ACTIVITY TOY

CROSS-REFERENCED TO RELATED APPLICATIONS

This application is a non-provisional application of application Ser. No. 61/925,742, filed Jan. 10, 2014 and claims priority from that application, which is also deemed incorporated by reference in its entirety in this application.

STATEMENT REGARDING FEDERALLY SPONSORED RESEARCH OR DEVELOPMENT

Not applicable

BACKGROUND OF THE INVENTION

I. Field of the Invention

This invention relates to generally to an interactive multiple activity toy for young children and more particularly to a switchbox incorporating an array of LED lights, a battery power supply, a plurality of control switches and a record/playback circuit arranged such that the child may operate the switches to create variable light patterns and may record and playback speech, music and other sounds.

II. Discussion of the Prior Art

It is well established that children, between the ages of one and five years, enjoy toys that they can manipulate to provide light patterns and sounds as one or more electrical switches are turned on and off. There are available on the market toy musical instruments having keyboards for playing musical tones and melodies. A toy guitar available from the Fisher Price Company has a plurality of switches, which when activated, select a style of music, e.g. jazz, rock & roll, heavy metal, etc., previously recorded and digitally stored for playback. The guitar also includes a series of LEDs that flash in different patterns as the music is being played.

While many toys currently on the market now incorporate record/playback modules, they do not afford the degree of interaction to maintain a child's interest for more than a short period of time. It is accordingly a principle object of present invention to provide a light box toy with record/playback capabilities along with an array of LEDs, each associated with a decorative image which becomes illuminated depending upon the particular switches that are actuated by the child. In addition, the light box of our invention also incorporates record/playback module so that music, vocal messages and other sounds can be recorded and subsequently played back as the child selects certain of a plurality of switches to actuate.

While the present invention is being described as a toy for young children, it may also be used as a therapy device with persons having motor skill problems, such as, for example, limitations on hand/eye coordination often found in patients having Parkinson's disease.

SUMMARY OF THE INVENTION

In accordance with the present invention, a multiple activity toy comprises a housing defining a chamber where the housing has a front face surface, a rear surface and a peripheral wall joined to and surrounding the front face surface and rear surface. Mounted on the front face surface are first and second three-way switches connected to a battery pack and to a string of series connected lights contained within the chamber where the light sources are fitted into apertures formed through the front face surface at plural discreet locations. Further included in the housing is a printed circuit board with components forming a record/playback circuit and having a plurality of push-button control switches mounted to the wall of the housing so as to be accessible to a user. A USB port is provided on the printed circuit board and is accessible through an opening in the rear surface allowing the record/playback circuit to be programmed via a PC or laptop. Overlaying each of the apertures in which the light sources are mounted is a graphic image that becomes illuminated when the light sources are turned on via one or the other of the first and second three-way switches.

DESCRIPTION OF THE DRAWINGS

The foregoing features, objects and advantages of the invention will become apparent to those skilled in the art from the following detailed description when considered along with the accompanying drawings in which.

Thus, the device of the present invention may find use in rehabilitation centers.

DESCRIPTION OF A PREFERRED EMBODIMENT

Figure 1:
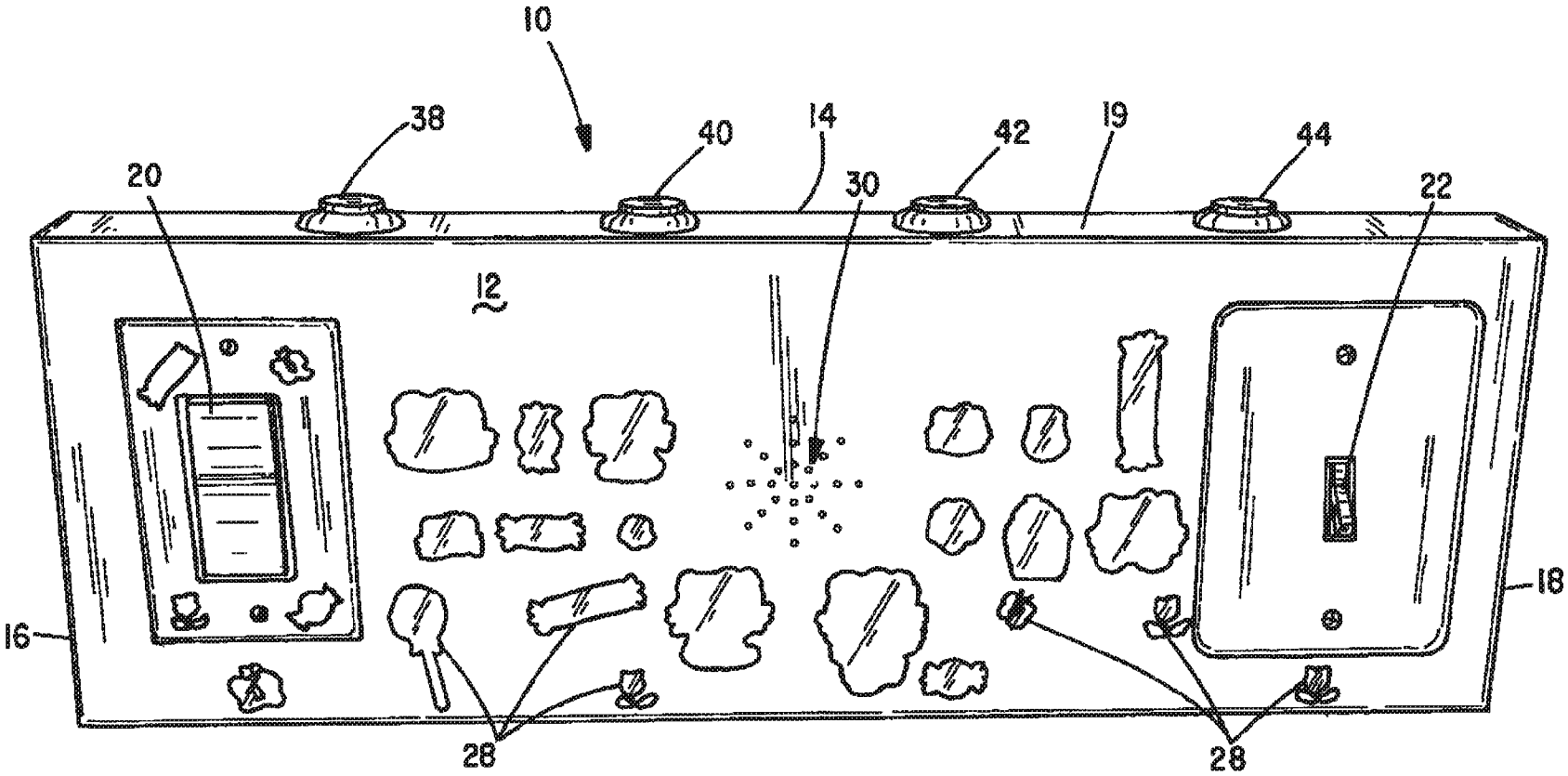
FIG. 1 is a frontal view of a preferred embodiment of the present invention.
Figure 2:
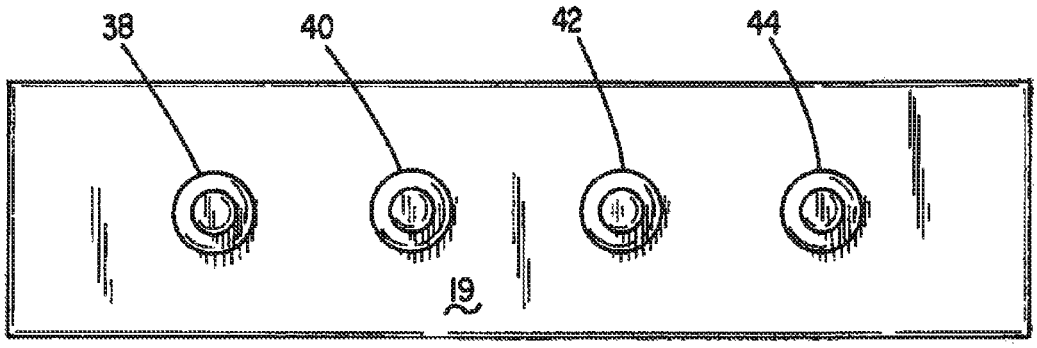
FIG. 2 is a top view thereof.

Referring to FIGS. 1 and 2, the multiple activity toy with record/playback capabilities is seen to include a box of rectangular cross-section indicated generally by numeral 10 that includes a front face 12, a rear face 14, a left end face 16 and right end face 18 and a top face 19.

The box 10 may be fabricated from a variety of materials including wood, plastic or metal.

Figure 3:
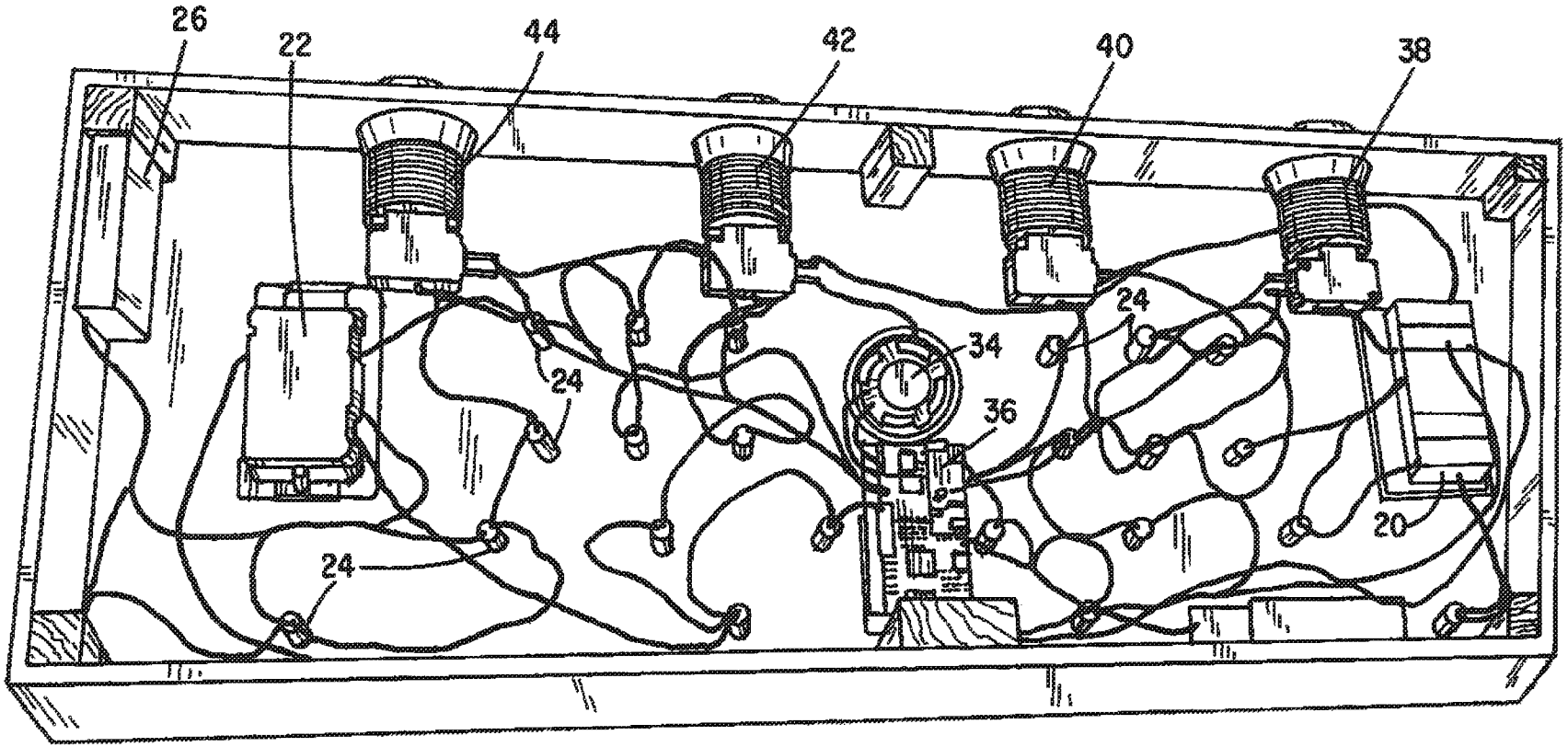
FIG. 3 is a rear view of the light box of FIG. 1 with a cover removed.

Referring still to FIG. 1, there is shown attached to the front face 12 at least one, but preferably a pair of three-way toggle switches 20 and 22. As seen in the view of FIG. 3, the front face 12 also includes a plurality of apertures, as at 24. Fitted into each of the apertures is an LED that is connected in circuit with the switches 20 and 22 and a battery pack 26 designed to hold four AAA batteries for powering the LEDs 24 and other electronic devices yet to be described. The battery pack is accessible by unscrewing the box's rear panel 14 or, alternatively, there may be a small removable panel (not shown) that only overlays the battery pack In FIG. 1 there is shown as covering each of the apertures 24 containing LEDs a broken graphic image, as at 28. These images 28 are translucent or a transparent translucent sticker or decal, preferably of an object attractive to a child. Thus, when the LEDs are illuminated, the particular sticker or decal covering it is highlighted. The graphic images can be customized by the user to adapt to the age and likings of the user.

Centrally located on the front face 12 of the box 10 are a plurality of through holes 30. The through holes 30 do not contain LEDs, but instead are aligned with a speaker cone 34 (FIG. 3) whereby the pattern of holes 30 facilitate sound transmission from inside the box to the ambient. While the described speaker is shown mounted to the obverse side of the front panel 12, it can also be mounted to the top panel 19 where a suitable hole pattern would also be provided. The speaker cone 34 preferably comprises part of a Model USB 5M recordable circuit available from Electronics123.com, Inc. The speaker 34 connects to a printed circuit card 36 located within the box 10. The printed circuit card 36 of the Model USB 5M record/playback device includes a microphone along with sound recording integrated digital circuitry including a memory for storing audio bitstreams. Shown on the top panel 19 of FIG. 2, are a plurality of pushbutton switches 40-44, which, when activated, cause a different prerecorded sound to be played. The switches 38, 40, 42 and 44 come as a part of the Model USB 5M five-section recordable circuit and which itself includes a LED used to confirm that it is in the "record" mode. The USB 5M module also includes a USB port that is made accessible through an opening in the rear panel. This allows the circuit module 36 to be programmed from a PC or a laptop computer.

Rather than individually coupling the plurality of LEDs to the battery supply 26 and the switches 20 and 22, it has been found convenient to adapt a string of commercially available LED Christmas tree lights for use in the box 10. They may be a multi-color string or all of the same color.

The combination of the plurality of child-operable control switches, the decorative decals and the LED light sources associated therewith as well as the record/playback capability built into the box of the present invention comprise a toy that will occupy a child's interest over extended periods. With the recording capability, different sounds of music, voice messages of a parent, as well as the child's own voice, can be stored and subsequently played back for the child's amusement.

Because the LEDs sources can be turned steadily on, the light box of the present invention can also serve as a room nightlight having appealing decorative graphics illuminated thereon. In this regard, the box can be mounted on a room wall or may simply be placed on a dresser or nightstand.

While a preferred embodiment is disclosed herein, those skilled in the art can make modifications to the shape and size of the box 10 without departing from the inventive concept.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices. Also, various modifications, both as to the equipment and operating procedures, can be accomplished without departing from the scope of the invention itself.

What is claimed is:

1. A multiple activity toy comprising:

(a) a housing defining a chamber and having at least one face surface, a rear surface and a wall joined to and surrounding the face surface and rear surface;

(b) first and second three-way switches mounted within the chamber, each with a switch actuator extending through the face surface;

(c) a string of series connected light sources contained within the chamber, said light sources fitted into apertures formed through the face surface at plural discrete locations;

(d) a battery pack contained in the housing and coupled through the first and second three-way switches to said string of light sources such that the light sources can be switched on and off from either of said first and second three-way switches;

(e) a record/playback circuit disposed in the housing and connected to a plurality of push-button control switches mounted to an interior side of the wall, said record/playback circuit including a memory for storing a plurality of audio bitstreams and where particular audio bitstreams read out from the memory is determined by which of the plurality of pushbutton control switches is activated, the record/playback circuit also connected to the battery pack and including a USB port; and (f) graphic image translucent stickers removably affixed to the face surface and overlaying said apertures that are illuminated when the light sources are turned on.

2. The multiple activity toy of claim 1 wherein the record/playback circuit can be programmed following connecting a laptop computer to the USB port.

* * * * *